United States Patent [19]

Hermanns et al.

[11] Patent Number: 4,964,582

[45] Date of Patent: Oct. 23, 1990

[54] METHOD AND APPARATUS FOR DETECTING THE BOBBIN CIRCUMFERENCE OF CROSS-WOUND BOBBINS AND FOR UTILIZING THE RESULT

[75] Inventors: Ferdinand-Josef Hermanns, Erkelenz; Rolf Haasen, Mönchengladbach, both of Fed. Rep. of Germany

[73] Assignee: W. Schlafhorst & Co., Mönchengladbach, Fed. Rep. of Germany

[21] Appl. No.: 328,963

[22] Filed: Mar. 27, 1989

[30] Foreign Application Priority Data

Mar. 26, 1988 [DE] Fed. Rep. of Germany ..... 3810365

[51] Int. Cl.[5] ..... B65H 63/08

[52] U.S. Cl. ..... 242/36; 242/18 R; 242/18 DD; 242/39

[58] Field of Search ..... 242/36, 39, 18 DD, 18 R, 242/28, 30, 49; 33/129

[56] References Cited

U.S. PATENT DOCUMENTS

| | | | |
|---|---|---|---|
| 3,739,996 | 6/1973 | Matsui et al. | 242/39 |
| 4,315,607 | 2/1982 | Felix | 242/36 |
| 4,447,955 | 5/1984 | Stutz et al. | 242/36 X |
| 4,715,550 | 12/1987 | Erni et al. | 242/39 |
| 4,805,844 | 2/1989 | Hermanns et al. | 242/36 X |
| 4,828,191 | 5/1989 | Ruge et al. | 242/18 R |

*Primary Examiner*—Stanley N. Gilreath

*Attorney, Agent, or Firm*—Herbert L. Lerner; Laurence A. Greenberg

[57] ABSTRACT

A method and apparatus for detecting and utilizing the bobbin circumference of cross-wound bobbins or cheeses in a textile machine producing the bobbins includes determining and evaluating the attained circumference of the cheese from measured values produced by sensors detecting the growth of the cheese. The measured values are continuously detected and processed and optionally stored in memory in at least one computer for further evaluation. A mathematical linkage symbolizing the current bobbin circumference cleansed of randomness in the current measured value pickup at very short time intervals based on the measured values for each winding station is continuously and repeatedly performed anew in the further evaluation. A parameter from the group consisting of current bobbin circumference, bobbin radius or bobbin diameter is calculated from the linkage. The linkage result is used with as little delay as possible for at least one purpose from the group consisting of displaying the result, and/or affecting the winding process, and/or detecting the yarn length and/or terminating the winding process.

38 Claims, 6 Drawing Sheets

METHOD AND APPARATUS FOR DETECTING THE BOBBIN CIRCUMFERENCE OF CROSS-WOUND BOBBINS AND FOR UTILIZING THE RESULT

SPECIFICATIONS

The invention relates to a method and an apparatus for detecting the bobbin circumference of cross-wound cylindrical or conical bobbins or cheeses in a textile machine producing such bobbins and for utilizing the result, in which a conclusion as to the attained circumference of the cheese is drawn from measured values that are produced by sensors detecting the growth of the cheese and are correspondingly evaluated. In automatic winding equipment, it is known to provide a "diameter shutoff" which enables the user to produce bobbins with predetermined final diameters. Such an apparatus must meet the following demands:

accurate methods for measuring the bobbin diameter at the particular winding station;

measuring methods independent of bobbin parameters; and good replicability of the diameter detection.

One simple method for detecting the diameter of a cross-wound bobbin or cheese is the measurement of the frame angle which is the angle formed between the initial position and a subsequent position of the bobbin frame after a certain amount. The bobbin diameter can then be calculated through the law of cosine, since the frame geometry remains unchanged. Such a measuring method has the further advantage of being independent of bobbin parameters.

However, the disadvantages of that method are major. Since the angle change during the winding time of a bobbin winding or production process amounts to only a few degrees, only complex and expensive angle transducers have the required diameter accuracy over the slight operating angle.

Furthermore, because of the vibrations of the bobbin frame and thus the vibratory changes in the bobbin frame angle, an angle transducer must be used that functions without wear. Angle transducers that have these properties are expensive. The expense for winding station hardware required for transmitting the measured rotational angle value to the winding station computer must also be included among these costs.

Another possibility for determining the bobbin diameter is to measure the period ratio of one bobbin revolution to one drive drum revolution. With the secondary condition that the circumferential speeds of the drum and bobbin are the same, such a ratio, multiplied by the drum diameter, results in the current bobbin diameter.

The advantages of that method are that it is simple to accomplish and low in cost. With conical cheeses, it is not the outer diameter but rather the driven diameter that is determined.

That method is imprecise and it is dependent on the bobbin parameters that have been set, such as yarn tension, supported weight, drum types, and so forth.

It is accordingly an object of the invention to provide a method and apparatus for detecting the bobbin circumference of cross-wound bobbins and for utilizing the result, which overcome the hereinafore-mentioned disadvantages of the heretofore-known methods and devices of this general type and which improve the quality of cross-wound bobbin production.

With the foregoing and other objects in view there is provided, in accordance with the invention, a method for detecting and utilizing the bobbin circumference of cross-wound bobbins or cheeses in a textile machine producing the bobbins, which comprises determining and evaluating the attained circumference of the cheese from measured values produced by sensors detecting the growth of the cheese, continuously detecting and processing and optionally storing the measured values in memory in at least one computer for further evaluation, continuously and repeatedly performing anew a mathematical linkage symbolizing the current bobbin circumference cleansed of randomness in the current measured value pickup at very short time intervals based on the measured values for each winding station in the further evaluation, calculating a parameter from the group consisting of current bobbin circumference, bobbin radius or bobbin diameter from the linkage, and using the linkage result with as little delay as possible for at lease one purpose from the group consisting of displaying the result, and/or affecting the winding process, and/or detecting the yarn length and/or terminating the winding process.

Cleansing randomness means removal of the arbitrary measurement inaccuracies due to an uneven bobbin surface and a not entirely even bobbin formation, during individual measurement steps.

The invention is based on the following observations:

If a cylindrical drive drum drives a conical bobbin by friction, then because of the friction ratios between the drum and the bobbin, an rpm ratio is established that relates to the driven diameter of the conical bobbin. The circumferential entail speed of smaller end of the bobbin is lower than the circumferential speed of the drum. The circumferential speed of the larger end of the bobbin is greater than the circumferential speed of the drum.

With the condition $$\surd_{Tr}=\gamma_{Tr}\omega_{tr}$$

and $$\surd_{Sp}=\gamma_{Sp}\cdot\omega_{Sp}$$

and the secondary condition:

$$\surd_{Tr}=\surd_{Sp}, \text{ then}$$

Formula 1

$$r_{Sp}=\frac{w_{Tr}}{w_{Sp}}\cdot r_{Tr}=\frac{T_{Sp}}{T_{Tr}}\cdot r_{Tr}$$

where $\surd_{Tr}$=circumferential speed of the drum $\surd_{Sp}$=circumferential speed of the bobbin $\gamma_{Sp}$=bobbin radius (neutral zone)

$\gamma_{Tr}$=drum radius $\omega_{Sp}$=bobbin angular speed $\omega_{Tr}$=drum angular speed $T_{Sp}$=bobbin period $T_{Tr}$=drum period The driven radius of the bobbin can be determined by formula 1.

In order to obtain a determination of the outer diameter or in other words the shutoff diameter of conical bobbins while using this formula, a study was made as to what laws govern the behavior of the driven diameter during bobbin operation.

The results of this study are as follows:

The driven diameter depends on the yarn tension (which varies during unwinding of the cop), on the bobbin conicity and on the supported weight of the bobbin.

The location of the driven diameter on the bobbin is relatively constant over the entire winding time.

Two phenomena are to be distinguished in this case:

1. the absolute location of the driven diameter, or the change in this location during the winding time; and 2. the relative location of the driven diameter (with fluctuations) or the change in this location resulting from yarn tension fluctuations.

The first phenomenon depends on the bobbin conicity. It is thus of less significance for the accuracy of replication of the measuring method.

The second phenomenon is responsible for the accuracy of replication of the measuring method. The wide range at low bobbin weight is striking. Yarn tension fluctuations during one cop unwinding time have a major effect. This range lessens the replication accuracy of the method. In order to ascertain the driven radius by formula 1, two measurable variables can be used: the time of the winding, and the number of revolutions of the bobbin during this time. In each case, an initial formula can be prepared as a function of these two parameters. For the bobbin diameter as a function of the winding time:

$$d(t) = d_0 + \delta \cdot \rho \frac{(t)}{\pi}$$

where d(t)=bobbin diameter as a function of winding timep(t)=swing angle of the bobbin as a function of the winding time;

$d_0$=initial diameter of the bobbin

δ=increase in bobbin radius per bobbin revolution v=speed of the yarn t=time With $\delta << d_0$, as well as:

$$d_{Sp}(t) = d_0 + \delta \cdot \rho \frac{Sp(t)}{\pi}, \text{ whereby}$$

whereby ρ(t)=ω(t), and $$d(t) = \frac{2 \cdot v}{w(t)} \text{ can be assumed,}$$

where:

$d_{Sp}$=bobbin diameter $d_{Sp}(t)$=bobbin diameter as a function of the winding time ω(t)=angular velocity according to time Φ(t)=derivative of the swing angle of the bobbin according to time.

After conversion, integration and insertion of formula 1, the following formula 2 is obtained for detecting the diameter based on the winding time measurement:

Formula 2:

$$d_{Sp} = \sqrt{d_0^2 + 6 \cdot \frac{\delta}{\pi} \cdot v \cdot t}$$

For the bobbin diameter as a function of the bobbin revolutions, the following applies according to formula 1:

$$d(t) = d_0 + \delta \cdot \frac{\rho(t)}{\pi} \text{ and } \frac{\rho(t)}{\pi} = 2 \cdot n_{Sp},$$

where $n_{Sp}$=number of bobbin revolutions.

In order to detect the diameter based on the measurement of bobbin revolution, the following formula 3 is obtained:

Formula 3:

$$d_{Sp} = d_0 + 2 \cdot \delta \cdot n_{Sp}.$$

The bobbin diameter can be calculated by both mathematical equations. The parameters to be determined for the particular bobbin are identical in both formulas, namely $d_0$ and δ. In the determination of the two parameters, a mathematical compensation process is required, which sets $d_0$ and δ in such a way that the sum of the measured diameter value with respect to the previously calculated diameter value over the error squared becomes minimal. This can be carried out in each case using a mathematical filter, such as a Kalman filter.

The values of the two parameters $d_{0K}$ referred to the initial diameter of the bobbin and after "$_K$" add (referred to the increase of the bobbin radius per bobbin revolution) and $\delta_K$ which express the theoretical bobbin diameter course in parameters, are determined with the aid of the filters. However, a control of the winding process, for instance a diameter shütoff, is not yet possible with the values of these parameters. If the values of these parameters and the current measured winding time or current number of bobbin revolutions are inserted into the formulas 2 and 3, then a diameter $d_m$ is obtained, which is cleansed of statistically distributed errors (property of the filters).

This kind of procedure is illustrated in the flow diagram of FIG. 7. The bobbin period $T_{Sp}$ of the cheese and the drum period $T_{Tr}$ of the drive drum are measured continuously. At precisely defined time intervals, the diameter $d_{Sp}$ of the cheese, that is A, is detected by formula 1. Since the number of revolutions B of the bobbin, or the winding time C, are known from the measurement of the bobbin period, then with the aid of the mathematical compensation method the values of the parameters $d_{0K}$ and $\delta_K$ and be determined in each case. In the mathematical compensation methods, the mathematical filters that are needed can be developed from formula 2 as D, and formula 3 as E. The diameter calculation can be done with the aid of formulas 2 and 3, so that after each measurement a new diameter value $d_m$ is present in each case. The growth of the bobbin diameter during the winding process is measurable as a result.

A conclusion as to the length $l_m$ of the wound yarn can be drawn from the diameter $d_m$. The generally valid ratio v . t=1 and the conversion of formula 2, provide a formula for calculating the yarn length:

Formula 4:

$$l_m = \frac{d_{Sp}^2 - d_{0K}^2}{6 \cdot \delta_K} \cdot \pi$$

If $d_{0K}$ and $\delta_K$ are simultaneously ascertained with the aid of the mathematical filter developed from formula 3, then the increase in length up to this time can be calculated.

Randomness in the current measured value pickup has been mentioned above. Without the steps according to the invention, the bobbin circumference can only be imprecisely ascertained. The effect on the winding process, the display, the detection of the yarn length or the detection of the bobbin diameter that is definitive for the termination of the winding process, or the yarn length that is definitive for the termination of the winding process, are correspondingly imprecise According to the invention provides, a bobbin circumference cleansed of randomness in the winding process can be ascertained with a substantially narrower imprecision range, so that influence can be exerted upon the winding process with much greater accuracy and with more-exact replicability, so that an overall increase in quality of cross-wound bobbin production can be attained. In accordance with another mode of the invention, there is provided a method wherein the measured values representing the growth of the cheese are detected continuously and processed for further evaluation in at least one winding station computer associated with the various winding stations of the textile machine; that the further evaluation is optionally performed in an overriding computer connected to the winding station computer or computers; that optionally in the overriding computer, a mathematically linkage symbolizing the current bobbin circumference cleansed of randomness in the current measured value pickup is performed repeatedly anew, continuously at very short time intervals, for the winding station or for each winding station based on its measured data; and that the linkage result is optionally transmitted again, with as little delay as possible to the winding station computer for the sake of display, of affecting the winding process, of detecting the yarn length, and/or for the sake of terminating the winding process.

In accordance with a further mode of the invention, there is provided a method wherein in the computer or in the overriding computer, in the context of the mathematical linkage, a mathematical compensation function is calculated repeatedly anew, continuously at very short time intervals, for the winding station based on its measurement data, which function symbolizes the current bobbin circumference over the winding time or the bobbin revolutions, the current value having been cleansed of randomness in the current measured value pickup; and that from this compensation function, the current bobbin circumference or bobbin radius or bobbin diameter is calculated In accordance with an added mode of the invention, there is provided a method wherein in order to detect the circumference of cheeses driven at the circumference by drive drums, the measured values of a sensor detecting the rotational angle of the drive drums are advantageously linked with the measured values of a sensor detecting the rotational angle of the cheese, in order to draw a conclusion from the linkage result as to the attained circumference of the cheese, and in the computer or in the overriding computer, from these linkage results continuously obtained repeatedly anew, the mathematical linkage effecting the elimination of randomness of the current measured value pickup, or the compensation function, is calculated repeatedly anew.

Accordingly, a continuous correction of the value or linkage result calculated a short time before takes place, and the accuracy of the detection of the bobbin circumference increases, at least up to a limit value In accordance with an additional mode of the invention, there is provided a method wherein in order to calculate the compensation function, selected measured values for the winding process, or their linkage results, are used. Advantageously, for calculating the compensation function, the measured values or their linkage results that are obtained from a selectable instant in the winding process on are utilized A predetermined period of time can also be selected, and this period of time can, for instance, extend to a period of time that is calculated from the particular instant of measurement and directed into the past, always with the same time interval In accordance with yet another mode of the invention, there is provided a method wherein the compensation function is calculated by means of mathematical filters. A filter on the order of a Kalman filter is advantageously used as the mathematical filter.

In accordance with yet a further mode of the invention, there is provided a method wherein the compensation function is represented as a polynomial.

In accordance with yet an added mode of the invention, there is provided a method wherein the angular speeds of the drive drums and of the cheese are measured and linked together and stored in memory in one of the computers, before the compensation function is calculated from the linkage results. Preferably, an overriding computer assumes the function of calculating the compensation function, and the compensation function in turn symbolizes the measurement result, cleansed of randomness.

Alternatively, in accordance with yet an additional mode of the invention, there is provided a method wherein the period ratio of the bobbin rotation to the drive drum rotation is detected and stored in memory in one of the computers, before the compensation function is calculated from these linkage results (see formula 1 above).

In accordance with still another mode of the invention, there is provided a method wherein in the computer or in the winding station computer, the signals, optionally transmitted from the overriding computer and representing the current bobbin circumference or bobbin radius or bobbin diameter, are again linked to signals representing the rotational angle of the cheese and/or the rotational angle of the drive drums, in order therefrom to calculate the current wound-up yarn length and/or the current winding density, or optionally to display them and compare them with set-point values, wherein an optional intervention into the winding process is made based on the result of the comparison.

The course of a winding process may, for instance, be stored in memory in the form of excerpts as a set-point or desired value. If the current winding process does not agree with the specified set-point winding process, then by varying the yarn tension, for instance, an influence can be exerted upon the winding density of the cheese, and the cheese can be regulated for instance either to constant winding density or to a winding density that varies continuously in the course of winding process. If tolerances should be exceeded in this process, then the winding process can be interrupted, because the cheese then no longer meets the required quality specifications in any case.

With the objects of the invention in view, there is also provided an apparatus for detecting and utilizing the bobbin circumference of cross-wound bobbins or cheeses in a textile machine producing the bobbins, comprising sensors detecting growth of the cheese and producing measured values and at least one computer connected to the sensors for determining and evaluating the attained circumference of the cheese from the measured values and processing the measured values for further evaluation; the computer receiving a linking program for a mathematical linkage of processed measured values cleansed of randomness in the current measured value pickup and symbolizing the current bobbin circumference; and the computer having means for utilizing the linkage result for at least one purpose from the group consisting of displaying the linkage result, and/or affecting the winding process in accordance with the linkage result, and/or detecting the yarn length in accordance with the linkage result, and/or terminating the winding process in accordance with the linkage result.

The linkage result may, for instance, be shown on a display. The winding process can be terminated, for instance, upon attainment of the desired yarn length or upon attainment of the desired current bobbin circumference. With conical bobbins, the current bobbin circumference is in the so-called neutral zone.

With the objects of the invention in view, there is furthermore provided an apparatus for detecting and utilizing the bobbin circumference of cross-wound bobbins or cheeses in a textile machine producing the bobbins, comprising sensors detecting growth of the cheese and producing measured values; at least one winding station computer connected to the sensors for determining and evaluating the attained circumference of the cheese from the measured values and processing the measured values for further evaluation; an overriding computer receiving a linkage program for a mathematical linkage of the measured values processed by the winding station computer being cleansed of randomness of the current measured value pickup and symbolizing the current bobbin circumference; a first operative connection connected between the winding station computer and the overriding computer; and a second operative connection connected between the winding station computer and the overriding computer for transmitting the linkage result to the winding station computer; the winding station computer having means for utilizing the linkage result for at least one purpose from the group consisting of displaying the linkage result, and/or affecting the winding process in accordance with the linkage result, and/or detecting the yarn length in accordance with the linkage result, and/or terminating the winding process in accordance with the linkage result.

In accordance with another feature of the invention, the linkage program is controlled for the calculation of a mathematical compensation function cleansed of randomness of the current measured value pickup and symbolizing the current bobbin circumference over the winding time or bobbin revolutions.

In accordance with a further feature of the invention, in order to display the compensation function, the linkage program advantageous has a mathematical filter.

In accordance with an added feature of the invention, the filter is a Kalman filter, which has proved to be suitable.

In accordance with an additional feature of the invention, the compensation function is representable as a polynomial in the computer or in the overriding computer. Polynomial representation of a function is particularly advantageous and suitable with a view toward the use of an electronic computer.

In accordance with yet another feature of the invention, in textile machines having cheeses driven at the circumference by drive drums, both the cheese and the drive drum each are assigned a sensor detecting the rotational angle.

In accordance with a concomitant feature of the invention, the sensor detecting the rotational angle, the computer or the winding station computer has a device for measuring the duration of passage through a rotational angle of a given size, and the computer, the winding station computer or the overriding computer has a program for determining the period ratio of the bobbin revolution to the drive drum revolution. The mathematical relationships associated with this feature have already been explained (see formula 1).

Other features which are considered as characteristic for the invention are set forth in the appended claims.

Although the invention is illustrated and described herein as embodied in a method and apparatus for detecting the bobbin circumference of cross-wound bobbins and for utilizing the result, it is nevertheless not intended to be limited to the details shown, since various modifications and structural changes may be made therein without departing from the spirit of the invention and within the scope and range of equivalents of the claims The construction and method of operation of the invention, however, together with additional objects and advantages thereof will be best understood from the following description of specific embodiments when read in connection with the accompanying drawings.

Figure 5:
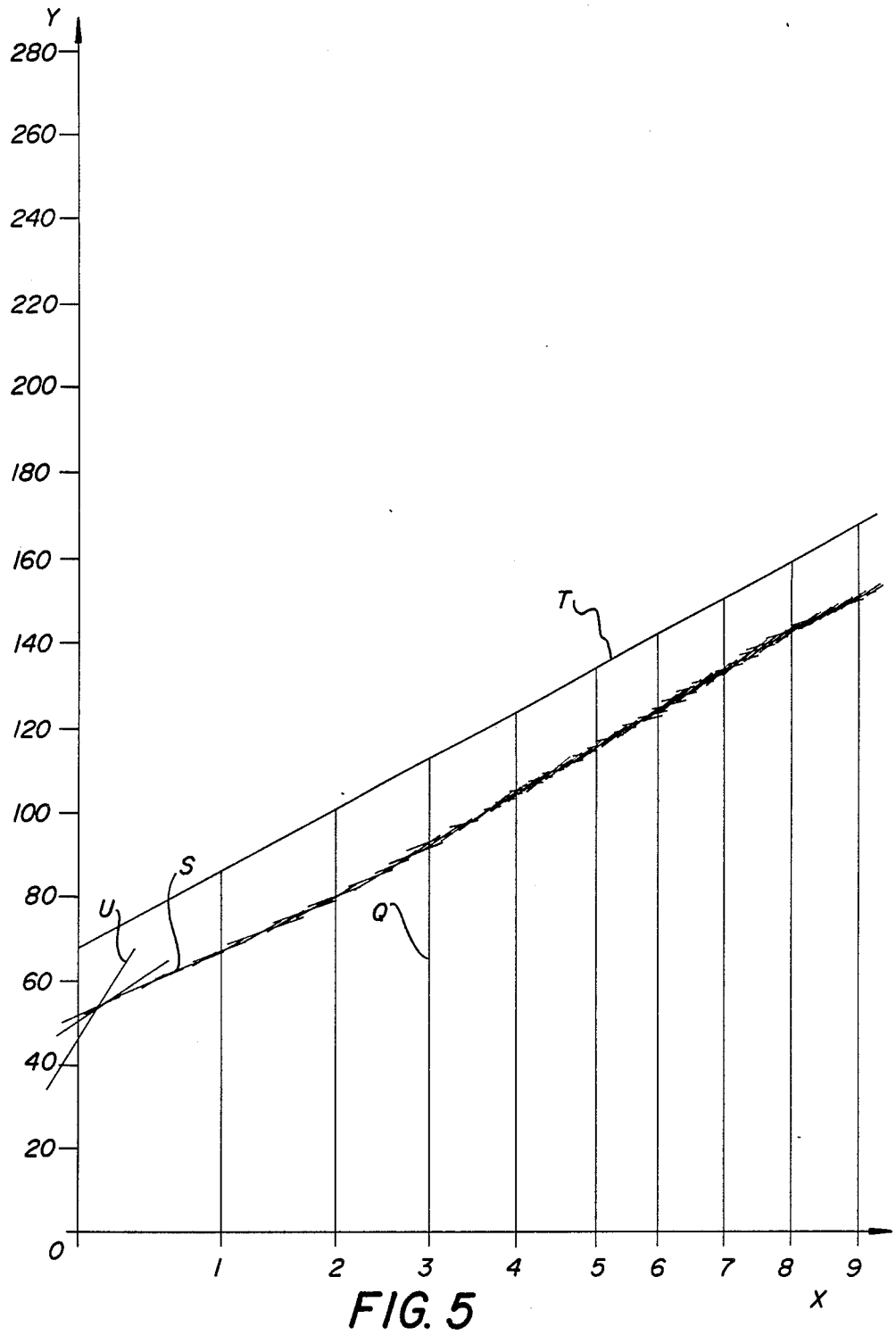
Figure 6:
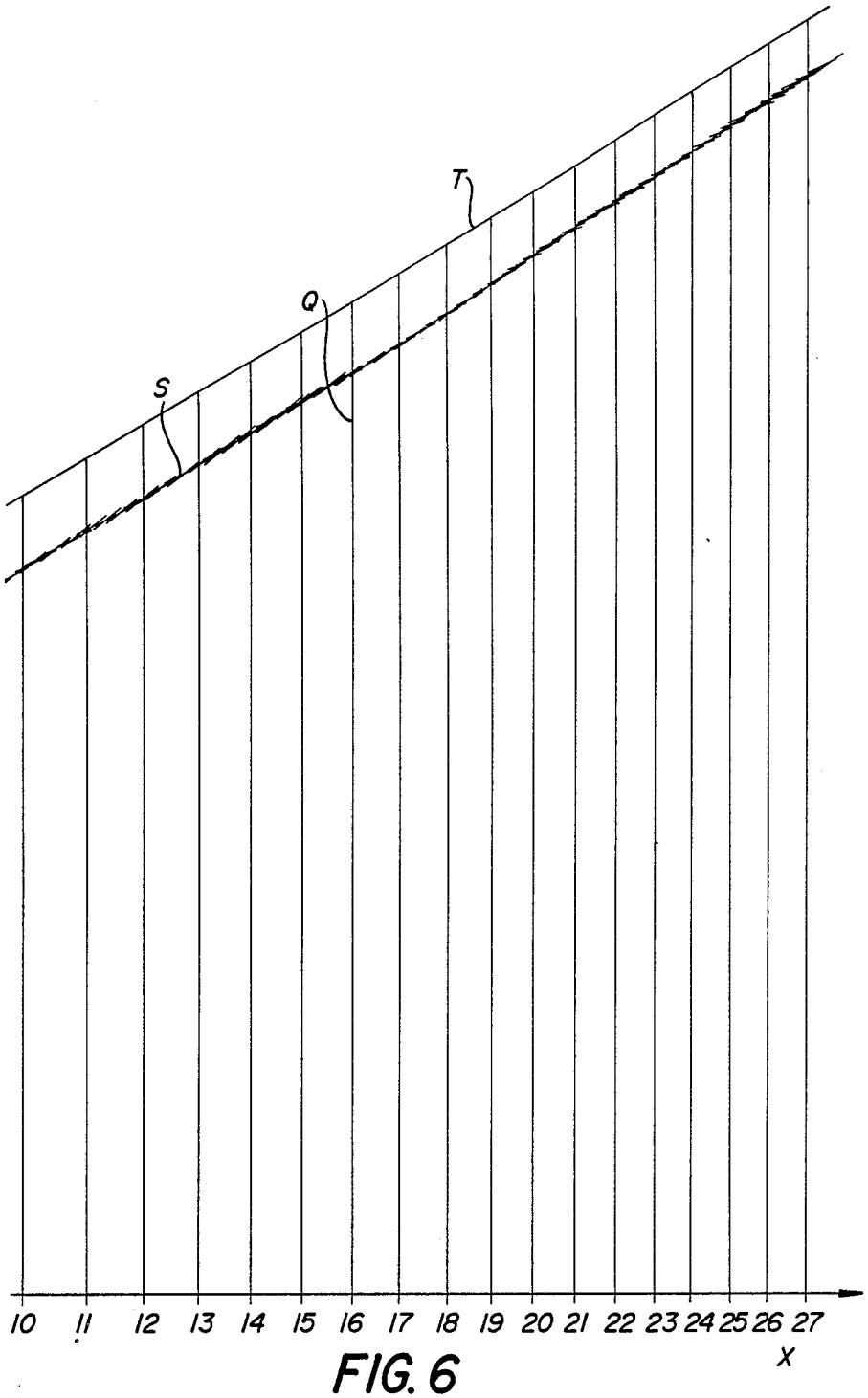

FIGS. 5 and 6 together are a diagram of a second winding process; and

Figure 7:
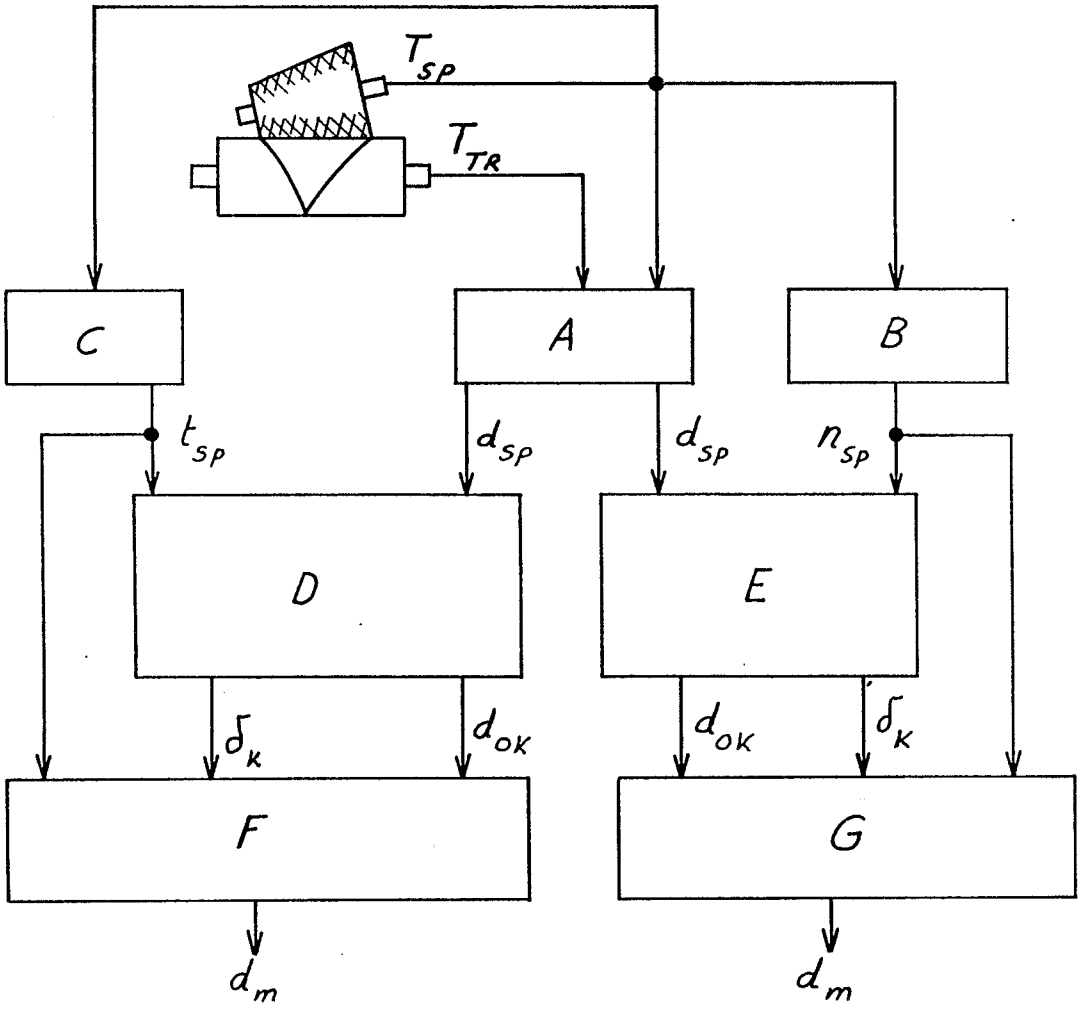

FIG. 7 is a flow diagram illustrating a procedure according to the invention.

Figure 1:
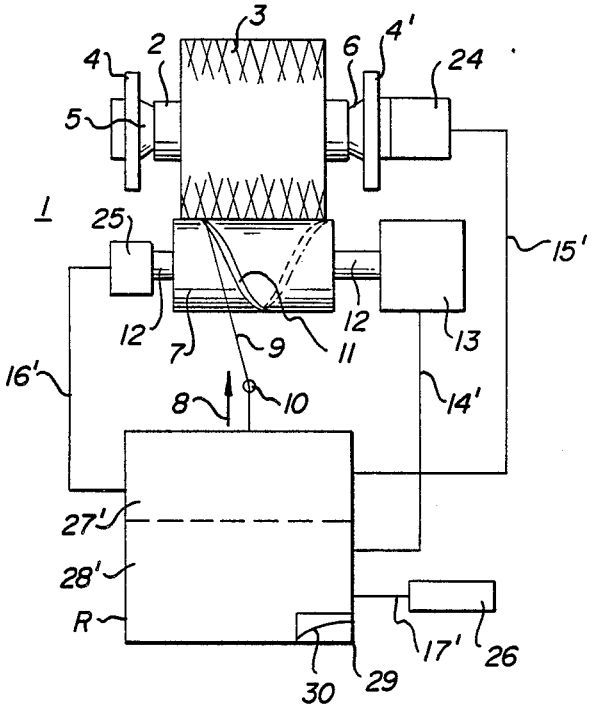
FIG. 1 is a diagrammatic and schematic view of a first exemplary embodiment of the invention.

Referring now to the figures of the drawing in detail and first, particularly, to FIG. 1 thereof, there is seen a tube 2 of a cross-wound bobbin or cheese 3 which is held by means of conical tube plates 5, 6 supported in a bobbin frame or creel 4, 4' at a winding station 1 of an automatic winding machine, which is not shown in further detail. The cheese 3 rests on a drive drum 7 and is set into rotation by friction with the drive drum 7. A yarn or thread 9 traveling in the direction of an arrow 8 passes through a yarn eyelet 10 before it reaches the cheese 3 and it is guided by a reverse-thread groove 11. The yarn 9 is drawn from a non-illustrated run-off bobbin, for instance a spinning cop.

In this exemplary embodiment, the drive drum 7 is secured to a shaft 12 of a drive motor 13.

A computer R is associated with the winding station 1. Sensors 24 and 25 and a display 26 are connected to the computer R for the drive motor 13 through electrical operative connections 14'–17'. The sensors 24 and 25 are rotational angle sensors. The rotational angle sensor 24 continuously measures the rotational angle of the tube plate 6 and therefore the rotational angle of the tube 2 and cheese 3 as well. The rotational angle sensor 25 continuously measures the rotational angle of the shaft 12 and therefore of the drive drum 7 as well. The measured values continuously reach an arithmetic unit 27' of the computer R, through the operative connections 15' and 16'. At time intervals of approximately one tenth of a second, the bobbin radius, which can simultaneously be used as a standard unit for the bobbin circumference, is determined by Formula 1 from the measured values just attained in the arithmetic unit 27'. However, instead of the bobbin radius, the bobbin circumference can be calculated directly.

Figure 3:
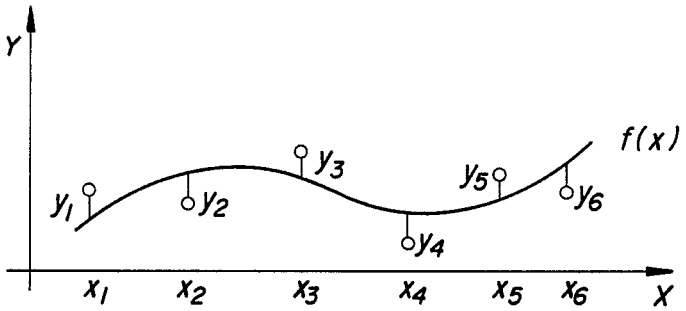
FIG. 3 is a graph showing a fundamental analytical representation of a compensation function.

The computer R contains a calculation program, with the aid of which a compensation function $y=f(x)$ is formed, as shown in FIG. 3.

If at times $x_1$–$x_6$, for instance, the bobbin radii $y_1$–$y_6$ calculated in the computer R are entered into the formula, these radii vary considerably upward and downward, although in the ideal case they should be located on a slightly rising, slightly convex line, so that the compensation calculation results in a compensation function that follows the thick solid line. In that case, the vertical intervals of the measured points from the curve course of the compensation function are approximately equal. The fluctuation width of the compensation function is less than the fluctuation width of the individual measured values.

The computer R then assures that only the compensation function $y=f(x)$ is evaluated. The linkage result reaches a control unit 28'. The control unit 28' has a set-point or desired value transducer 29, upon which a set-point or desired value winding process following a curve course 30, has been imposed The control unit 28' is then capable of influencing the bobbin speed by controlling the drive motor 14, with the objective of adapting the actual winding process, symbolized by the compensation function $y=f(x)$ according to FIG. 3, to the set-point winding process 30. The current bobbin circumference, or bobbin radius, or bobbin diameter ascertained by the computer R is shown on the display 26.

The exemplary embodiment of FIG. 2 differs from that of FIG. 1 in the following respects:

A winding station computer SR is associated with the winding station 1. The drive motor 13, sensors 24' and 25', a display 26 and an overriding computer or central computer ZR are connected to the winding station computer SR through electrical operative connections 14–19. Further operative connections 20, 21 and 22, 23 lead from the central computer ZR to other winding station computers.

The two sensors 24' and 25' in this case contain devices for measuring the duration of passage through a rotation angle of a given size. The sensor 24' uninterruptedly emits the period of a one-quarter revolution of the tube plate 6 to the arithmetic unit 27 of the winding station computer SR through the operative connection 15. To this end, the rearward end of the tube plate 6 is provided with four magnets 31 which are distributed uniformly over the circumference thereof. The passage of the magnets past the sensor 24' is detected by the sensor. In the same manner, the sensor 25' uninterruptedly transmits the period of a one-quarter revolution of the winding roller 7 to the arithmetic unit 27. To this end, the rearward end of the shaft 12, which is supported in a bearing 33, has a disk 34 which carries four magnets 32 that are distributed uniformly over the circumference thereof. The passage of the magnets past the sensor 25' is detected by the sensor.

The results of the measurement are processed in accordance with the description of FIG. 1 and some of the results are sent to the central computer ZR.

The central computer ZR contains the calculation program with the aid of which a compensation function $y=f(x)$ according to FIG. 3 is formed.

The linkage result travels from the central computer ZR through the operative connection 19 back to a control unit 28 of the winding station computer SR. The control unit 28 has a set-point transducer 29, upon which a set-point winding process following the curve course 30 is imposed. The control unit 28 is then in a position to affect the bobbin speed by controlling the drive motor 13, with the objective of adapting the actual winding process, symbolized by the compensation function $y=f(x)$ of FIG. 3, to the set-point winding 30. The current bobbin circumference or bobbin radius or bobbin diameter, fed back from the central computer ZR, is shown at the display 26.

Figure 4:
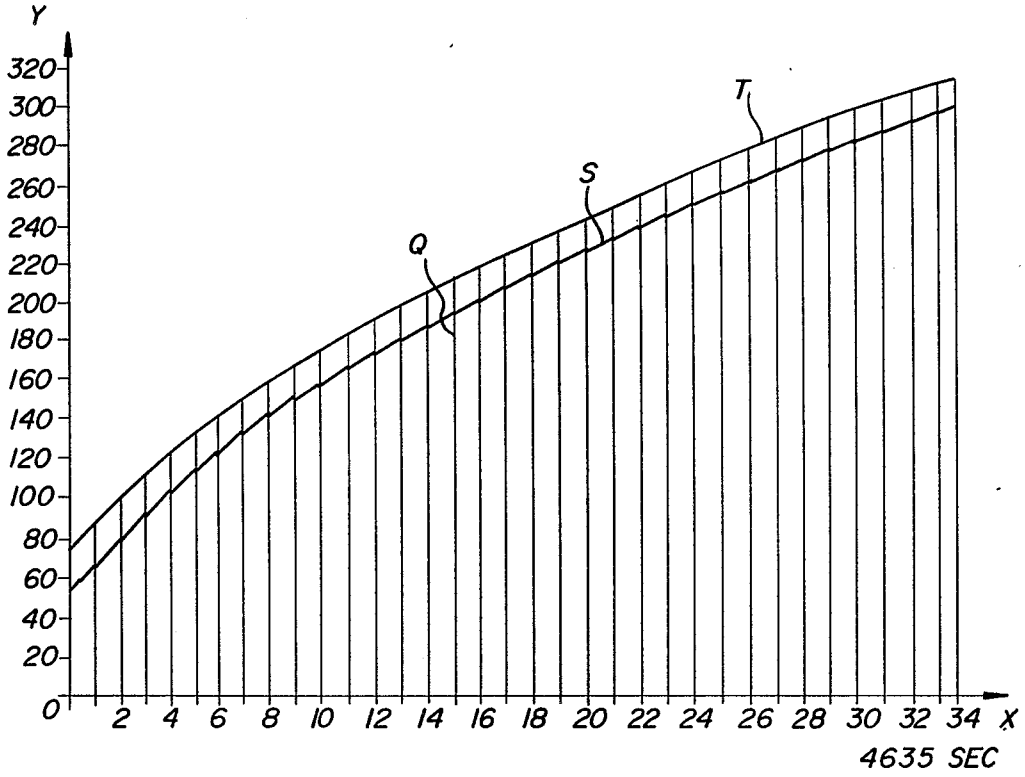
FIG. 4 is a diagram showing a first winding process.

FIG. 4 shows a diagram of a winding process, illustrating how it could be reproduced in the display 26, for instance, or expressed by the winding station computer SR. The winding time is plotted on the X axis The vertical dashes Q indicate winding stoppages, which have been dictated by a change of spinning cops. The cheese diameter is plotted on the Y axis. The lower curve course S, reproduces the result of a calculation of the arithmetic unit 27 of the exemplary embodiment of FIG. 1. Each time there is a change of run-off bobbin, the curve course jumps markedly, and during the run-off travel of the run-off bobbin, the curve course is likewise very uneven, although this is not as clearly visible in FIG. 4.

Since the cheese in question in this case is intended to be a conical cheese, on one hand the lower curve course S reproduces the measured driven diameter, while on the other hand the upper curve course T reproduces the diameter on the thick bobbin end.

Figure 2:
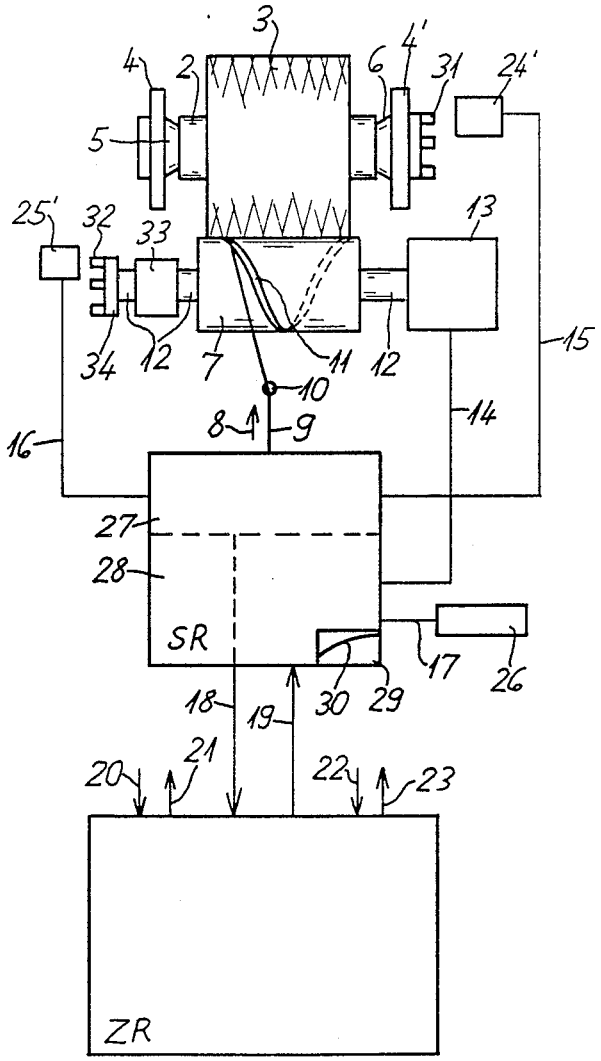
FIG. 2 is a view similar to FIG. 1 of a second exemplary embodiment of the invention.

FIGS. 5 and 6 are an excerpt from the log of one winding process, performed by an apparatus according to FIG. 2, for a conical cheese. The bobbin revolutions and the run-off bobbin change are plotted on the X axis. The individual changes in run-off bobbin are marked with increasing numbers. The cheese diameter is plotted on the Y axis. The lower curve course S, shown in solid lines, is obtained by continuous application of tangents U to the compensation curve of the current diameter of the conical cheese, as ascertained by the central computer ZR. The very unevenly running curve S of the diameter calculated by the arithmetic unit 27 and based on the measured values of the sensors 24' and 25' is plotted within this curve course and protrudes out of the curve course at peaks. The calculation program of the central computer ZR in this case contains a Kalman filter to ascertain the compensation curve. The compensation function improves continuously from the beginning of the winding process on, because the Kalman filter allows past measurement results to flow into it as well. The width of the window of detection can be controlled.

The vertical dashes Q in each case mark winding interruptions required for changing the run-off bobbins or cops delivery yarn. Each time a run-off bobbin was changed, the diameter of the conical cheese was ascertained manually at its thick end. The ascertained values were subsequently entered into the log printed out by the winding station computer SR. The connecting line represents the upper curve course T, shown in solid lines.

We claim:

1. Method for detecting and utilizing the bobbin circumference of cross-wound cylindrical or conical bobbins or cheeses in a textile machine producing the bobbins, which comprises:

determining and evaluating the attained circumference of the bobbin from measured values produced by sensors detecting the growth of the bobbin, continuously detecting and processing the measured values in at least one computer for further evaluation, continuously and repeatedly performing anew a mathematical linkage symbolizing the current bobbin circumference cleansed of randomness in the current measured value pickup at very short time intervals based on the measured values for each winding station in the further evaluation, calculating a parameter from the group consisting of current bobbin circumference, bobbin radius and bobbin diameter from the linkage, and using the linkage result with as little delay as possible for at least one purpose from the group consisting of displaying the result, affecting the winding process, detecting the yarn length and terminating the winding process.

2. Method according to claim 1, which comprises storing the measured values in memory.

3. Method according to claim 1, which comprises continuously detecting and processing the measured values for further evaluation in at least one winding station computer associated with various winding stations of the textile machine 4. Method according to claim 3, which comprises performing the further evaluation in an overriding computer connected to the at least one winding station computer; continuously and repeatedly performing anew a mathematical linkage symbolizing the current bobbin circumference cleansed of randomness in the current measured value pickup at very short time intervals based on the measured values for the at least one winding station in the overriding computer; and transmitting the linkage result again with as little delay as possible to the winding station computer for at lease one purpose from the group consisting of displaying the result, affecting the winding process, detecting the yarn length and terminating the winding process.

5. Method according to claim 1, which comprises continuously and repeatedly calculating anew a mathematical compensation function at very short time intervals based on the measured values for the winding station in the context of the mathematical linkage in the computer, the compensation function symbolizing the current bobbin circumference over a parameter from the group consisting of the winding time and the bobbin revolutions, the current value having been cleansed of randomness in the current measured value pickup; and calculating a result from the compensation function from the group consisting of the current bobbin circumference, the bobbin radius and the bobbin diameter.

6. Method according to claim 4, which comprises continuously and repeatedly calculating anew a mathematical compensation function at very short time intervals based on the measured values for the winding station in the context of the mathematical linkage in the overriding computer, the compensation function symbolizing the current bobbin circumference over a parameter from the group consisting of the winding time and the bobbin revolutions, the current value having been cleansed of randomness in the current measured value pickup; and calculating a result from the compensation function from the group consisting of the current bobbin circumference, the bobbin radius and the bobbin diameter.

7. Method according to claim 1, which comprises detecting the circumference of bobbins driven by drive drums at the circumference thereof by linking the measured values of a sensor detecting the rotational angle of the drive drums with the measured values of a sensor detecting the rotational angle of the bobbin, in order from the linkage result for determining the attained circumference of the bobbin, and repeatedly calculating anew the mathematical linkage effecting the elimination of randomness of the current measured value pickup from the linkage results continuously obtained repeatedly anew in the computer.

8. Method according to claim 6, which comprises detecting the circumference of bobbins driven by drive drums at the circumference thereof by linking the measured values of a sensor detecting the rotational angle of the drive drums with the measured values of a sensor detecting the rotational angle of the bobbin, in order from the linkage result for determining the attained circumference of the bobbin, and repeatedly calculating anew the compensation function from the linkage results continuously obtained repeatedly anew in the overriding computer.

9. Method according to claim 5, which comprises calculating the compensation function from selected measured values for the winding process.

10. Method according to claim 5, which comprises calculating the compensation function from the linkage results.

11. Method according to claim 5, which comprises calculating the compensation function from the measured values.

12. Method according to claim 5, which comprises calculating the compensation function from the linkage results obtained from a selectable instant in the winding process.

13. Method according to claim 5, which comprises calculating coefficients of the compensation function with mathematical filters.

14. Method according to claim 5, which comprises calculating coefficients of the compensation function with a Kalman filter.

15. Method according to claim 5, which comprises representing the compensation function as a polynomial.

16. Method according to claim 10, which comprises measuring, linking together and storing the angular speeds of the drive drums and of the bobbin in memory in one of the computers, before the compensation function is calculated from the linkage results.

17. Method according to claim 10, which comprises detecting and storing the period ratio of the bobbin rotation to the drive drum rotation in memory in one of the computers, before the compensation function is calculated from the linkage results.

18. Method according to claim 4, which comprises again linking the signals transmitted from the overriding computer and representing a parameter from the group consisting of the current bobbin circumference, the bobbin radius and bobbin diameter to signals representing at least one parameter from the group consisting of the rotational angle of the bobbin and the rotational angle of the drive drums in one of the computers, for calculating at least one parameter from the group consisting of the current wound-up yarn length and the current winding density therefrom.

19. Method according to claim 18, which comprises displaying and comparing the at least one parameter from the group consisting of the current wound-up yarn length and the current winding density with set-point values.

20. Method according to claim 19, which comprises intervening into the winding process based on the result of the comparison.

21. Apparatus for detecting and utilizing the bobbin circumference of cross-wound cylindrical of conical bobbins or cheeses in a textile machine producing the bobbins, comprising means for holding a bobbin, means for driving the bobbin, sensors detecting movement of said driving means and movement of the bobbin and producing signals; and at least one computer connected to said sensors for determining and evaluating the attained circumference of the bobbin from the signals and processing the signals for further evaluation; said computer receiving a linking program for a mathematical linkage of processed signals cleansed of randomness in the current signal pickup and symbolizing the current bobbin circumference; and said computer having means for utilizing the linkage result for at least one purpose from the group consisting of displaying the linkage result, affecting the winding process in accordance with the linkage result, detecting the yarn length in accordance with the linkage result, and terminating the winding process in accordance with the linkage result.

22. Apparatus according to claim 21, wherein the linkage program controls a calculation of a mathematical compensation function cleansed of randomness of the current signal pickup and symbolizing the current bobbin circumference over a parameter from the group consisting of winding time and bobbin revolutions.

23. Apparatus according to claim 22, wherein the linkage program has a mathematical filter for representing the compensation function.

24. Apparatus according to claim 23, wherein the filter is a Kalman filter.

25. Apparatus according to claim 22, wherein the compensation function is represented in said computer as a polynomial.

26. Apparatus according to claim 21, including a drive drum of a textile machine driving the circumference of the bobbin, said sensors including one sensor detecting the rotational angle of the bobbin and another sensor detecting the rotational angle of the drive drum.

27. Apparatus according to claim 26, wherein said sensors have a device for measuring the duration of the passage of said holding means through a rotational angle of given magnitude.

28. Apparatus according to claim 26, wherein said computer has a device for measuring the duration of the passage of said holding means through a rotational angle of given magnitude.

29. Apparatus according to claim 26, wherein said computer has a program for detecting the period ratio of the bobbin revolution to the drive drum revolution.

30. Apparatus for detecting and utilizing the bobbin circumference of cross-wound cylindrical or conical bobbins or cheeses in a textile machine producing the bobbins, comprising means for holding a bobbin, means for driving the bobbin, sensors detecting movement of said driving means and movement of the bobbin and producing signals; at least one winding station computer connected to said sensors including means for controlling a calculating for determining and evaluating the attained circumference of the bobbin from the signals and processing the signals for further evaluation; an overriding computer receiving a linkage program for a mathematical linkage of the signals processed by said winding station computer being cleansed of randomness of the current signal pickup and symbolizing the current bobbin circumference; a first operative connection connected between said winding station computer and said overriding computer; and a second operative connection connected between said winding station computer and said overriding computer for transmitting the linkage result to said winding station computer; said winding station computer having means for utilizing the linkage result for at least one purpose from the group consisting of displaying the linkage result, affecting the winding process in accordance with the linkage result, detecting the yarn length in accordance with the linkage result, and terminating the winding process in accordance with the linkage result.

31. Apparatus according to claim 30, wherein said computer controls a calculation of a mathematical compensation function cleansed of randomness of the current signal pickup and symbolizing the current bobbin circumference over a parameter from the group consisting of winding time and bobbin revolutions based on the linkage program.

32. Apparatus according to claim 31, wherein the linkage program has a mathematical filter for representing the compensation function.

33. Apparatus according to 32, wherein the filter is a Kalman filter.

34. Apparatus according to claim 31, wherein the compensation function is represented in said overriding computer as a polynomial.

35. Apparatus according to claim 30, including a drive drum of a textile machine driving the circumference of the bobbin, said sensors including one sensor detecting the rotational angle of the bobbin and another sensor detecting the rotational angle of the drive drum.

36. Apparatus according to claim 35, wherein said sensors have a device for measuring the duration of the passage through a rotational angle of given magnitude.

37. Apparatus according to claim 35, wherein said winding station computer has a device for measuring the duration of the passage through a rotational angle of given magnitude.

38. Apparatus according to claim 35, wherein one of said computers has a program for detecting the period ratio of the bobbin revolution to the drive drum revolution.

* * * * *